United States Patent [19]

Kuo

[11] Patent Number: 4,949,875

[45] Date of Patent: Aug. 21, 1990

[54] DISPENSER WITH INTEGRATED COVER FOR PASTE-LIKE MATERIAL

[76] Inventor: Youti Kuo, 88 Foxbourne Rd., Penfield, N.Y. 14526

[21] Appl. No.: 276,934

[22] Filed: Nov. 28, 1988

Related U.S. Application Data

[63] Continuation-in-part of Ser. No. 94,938, Sep. 10, 1988, Pat. No. 4,787,765.

[51] Int. Cl.[5] ..... B67D 5/42

[52] U.S. Cl. ..... 222/156; 222/256; 222/327; 222/340; 222/383; 222/386; 222/387

[58] Field of Search ..... 222/327, 340, 386, 383, 222/387, 400.5, 256, 391, 156, 214

[56] References Cited

U.S. PATENT DOCUMENTS

| | | | |
|---|---|---|---|
| Re. 31,408 | 10/1983 | Czech et al. | 222/341 |
| 4,394,939 | 7/1983 | Thor et al. | 222/207 |
| 4,402,431 | 9/1983 | Wiegner et al. | 222/207 |
| 4,485,943 | 12/1984 | Czech | 222/256 |
| 4,487,341 | 12/1984 | Daykins et al. | 222/391 |
| 4,511,068 | 4/1985 | Bossina | 222/257 |
| 4,538,747 | 9/1985 | von Schuckmann | 222/260 |
| 4,565,306 | 1/1986 | Nakanishi et al. | 222/383 |
| 4,651,902 | 3/1987 | Hobbs | 222/156 X |
| 4,684,043 | 8/1987 | Foster | 222/400.5 X |
| 4,749,106 | 6/1988 | VonSchuckmann et al. | 222/391 X |
| 4,793,522 | 12/1988 | Corsette | 222/340 X |
| 4,796,786 | 1/1989 | Czech | 222/327 X |
| 4,830,228 | 5/1989 | Fillmore | 222/387 X |
| 4,848,598 | 7/1989 | McKinney | 222/391 |

FOREIGN PATENT DOCUMENTS

| | | | |
|---|---|---|---|
| 286608 | 10/1988 | European Pat. Off. | 222/214 |

*Primary Examiner*—Kevin P. Shaver
*Assistant Examiner*—Gregory L. Huson
*Attorney, Agent, or Firm*—Fred L. Denson

[57] ABSTRACT

A dispenser for paste-like materials is described which has a cover that automatically seals the dispenser's spout when no material is pumped therefrom thereby protecting the spout and its immediate surroundings from ambient air. The cover automatically unseals the spout while material is being dispensed. The dispenser includes (1) a housing, (2) a reservoir or replaceable cartridge for storing paste-like material, (3) a pump for causing the flow of a controlled quantity of material from the reservoir or cartridge, through a channel and its discharge from the spout and (4) an integrated, rotatable cover containing a sealing cap for the spout and a plunger for activating the pump. The sealing cap and plunger move in concert with each other so that material is pumped from the spout after the sealing cap moves away from the spout. The dispenser eliminates the need for the manual replacement of caps, seals, plugs, covers and the like and provides an efficient seal which eliminates unwanted caking in the spout caused by dried out material.

6 Claims, 5 Drawing Sheets

DISPENSER WITH INTEGRATED COVER FOR PASTE-LIKE MATERIAL

CROSS REFERENCE TO RELATED APPLICATIONS

This application is a continuation-in-part of copending application Ser. No. 07/094938 filed Sept. 10, 1988 by Youti Kuo now U.S. Pat. No. 4,787,765 issued on Nov. 29, 1988.

BACKGROUND OF THE INVENTION

1. Field of the Invention

This invention relates to a dispenser for paste-like materials. The dispenser has multiple seals and an integrated cover which automatically open when material is being dispensed and automatically close when material is not being dispensed. Various embodiments include a removable cartridge for replenishing material and a movable applicator.

2. Description of Related Art

In recent years toothpaste pumps have been widely accepted by consumers as a convenient way for dispensing toothpaste. Pump dispensers have also been used for dispensing other viscous materials such as cosmetic creams, lotions and the like. Consumer preference for using pump dispensers rather than tube type dispensers is at least partially attributable to the pump's rigid shape, its ability to stand upright on a surface and the ease with which the remaining or residual contents are removed when the dispenser is in a near empty state. Notwithstanding these advantages, pump dispensers are more expensive to fabricate than tube type dispensers and are not reusable. Moreover, many pump dispensers have more than one sealing cap which must be manually replaced after each use for hygienic purposes as well as to prevent toothpaste from becoming dried out by ambient air and thereby clogging the dispenser's spout.

A variety of pump dispensers are described in the prior art. Several improvements have recently been made in the design and fabrication of such dispensers. U.S. Pat. No. 4,511,068 as well as U.S. Pat. Nos. 4,538,747 and 4,485,943 describe toothpaste pumps which are more economical to fabricate than comparative prior art devices. The cost for producing the pumps described in these patents is still much greater than the manufacturing cost for tube type dispensers. Moreover, the patented dispensers are not reusable and must be discarded when the contents are depleted. Other patents, such as U.S. Pat. No. 4,394,939, U.S. Pat. No. 4,402,431 and Reissue No. 31,408, disclose improvements in controlling the quantity of material discharged. While these patents describe dispensers which more efficiently control each dose of discharged material as compared to other prior art devices, the number and arrangement of parts required to accomplish this purpose adds to the fabrication costs. This same consideration applies to U.S. Pat. No. 4,565,306 which discloses a pump that is capable of more rapidly discharging toothpaste than other available dispensers.

Each of the dispensers described in the referenced patents recognizes that the dispensers must be carefully sealed when not in use to prevent unwanted caking of dried material which clogs the discharge spout. In most cases, two seals are used to ensure that the spout is not exposed to ambient air when the dispenser is not in use. Typically, a plug is placed in the spout and a cover is placed over the spout after each use to protect the material from the ambient air. This poses an inconvenience to the user since the cover and plug must be separately, manually removed and replaced after each use. Thus, the prevention of clogging and the continued efficiency of the dispenser are dependent on the user manually replacing the plug and cap after each use.

Certain brands of toothpaste are marketed in a dispenser which has a flap for sealing the spout instead of a plug. In this type of dispenser, the flap is attached to a handle which actuates the pump in a manner such that the flap is removed from the spout when a pumping pressure is applied to the handle. Because the flap does not efficiently provide an air tight seal, the dispenser also contains a cover to protect the spout from ambient air. The cover must be manually removed prior to pumping and unsealing. In this type of dispenser, material is pumped when the spout is partially opened which at times causes the formation of residual material around the spout. Despite the use of a sealing flap, possible clogging or caking is prevented or reduced only by the additional step of manually repositioning the removable cover after each use.

The objects of the present invention are to provide a dispenser for paste-like materials wherein the dispenser's spout is automatically sealed and covered after each use; to provide a reusable dispenser which is economically more efficient on a cost per use basis than other comparative dispensers because of its reusability; to provide a dispenser which discharges a controlled quantity of material during each application; and to provide a dispenser which has a movable spout for increased accessibility and for distribution of a length of material over a stationary surface.

SUMMARY OF THE INVENTION

In accordance with the present invention, a dispenser for paste-like material having an integrated, rotatable cover is provided which automatically and efficiently seals the dispenser's spout after material is pumped from the dispenser thereby protecting the spout from ambient air. Sealing is accomplished with a sealing cap which moves in conjunction with a plunger that activates the dispenser's pump. In its closed position, the cover provides additional protection to the spout and its surroundings from ambient air. The plunger and cap are attached to the dispenser's cover which is movably attached to the dispenser housing. The sealing cap extends beyond the peripheral edge of the spout to ensure that an efficient seal is provided which further protects the spout from the ambient air. Also, the sealing cap uncovers the spout before any material is pumped from the dispenser. This reduces unwanted residual material in the spout since such material leads to caking and clogging. As the sealing cap is moved toward the fully open position, a pumping force is sequentially provided by the plunger activating a piston. The delayed activation of the pump occurs because the plunger is spaced apart from the pump piston when the spout is sealed. The plunger moves toward the piston and contacts it only after the sealing cap begins to move toward the open position.

In addition to the integrated, rotatable cover, the housing also includes a reservoir for storing paste-like material and a disc which is slidably mounted into the reservoir at its base. The purpose of the disc is to prevent backflow of material when a pumping force is applied. The material is optionally stored in a removable cartridge which is inserted in the reservoir. When material is pumped from the reservoir or cartridge, it passes through an orifice in the piston, through a channel and is discharged from the dispenser's spout. In one embodiment, the material passes from the channel and through a movable applicator before it is discharged from the spout. The sealing cap for the spout is automatically placed in the open position when material is discharged and automatically returns to its closed position when the application of the pumping force is discontinued.

The dispenser of the invention provides an efficient seal because of the extended length of the sealing cap in relation to the spout opening and also because of the manner in which closure occurs. The positioning of the sealing cap is fully automatic and does not involve the manual replacement of plugs, flaps, seals or covers by the user. Unwanted caking and clogging of dried material in the spout opening is eliminated because of the seal's efficiency and because of the delayed sequential pumping action which does not occur until after the seal cap uncovers the spout.

The use of a replaceable cartridge containing paste-like material makes the dispenser of this invention economically advantageous over prior art dispensers. Because it is refillable, the instant dispenser has a substantially longer life than conventional dispensers which are discarded when the contents are depleted. The movable applicator improves the accessability of the spout. As it moves, it dispenses a length of material onto a stationary surface. This is particularly beneficial when the dispenser is attached to a wall or a surface or is otherwise stationed in a fixed position.

The operation of the piston provides for the pumping and discharge of a controlled quantity of material from the reservoir or cartridge. Because the dispenser does not require the manual removal and replacement of covers, seals, caps or plugs, it is completely operable with only one hand. This ease of operation is particularly beneficial to children and the physically impaired.

The invention and its objects and advantages will become more apparent by referring to the accompanying drawings and to the ensuing detailed description of the preferred embodiments.

DETAILED DESCRIPTION OF THE PREFERRED EMBODIMENTS

Figure 1C:
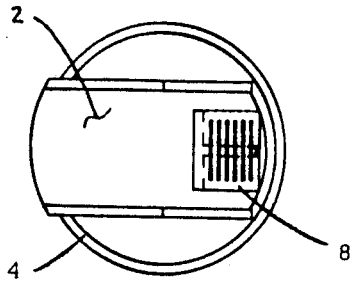
FIG. 1*c* is a top view of the dispenser of FIG. 1*a*.
Figure 1A:
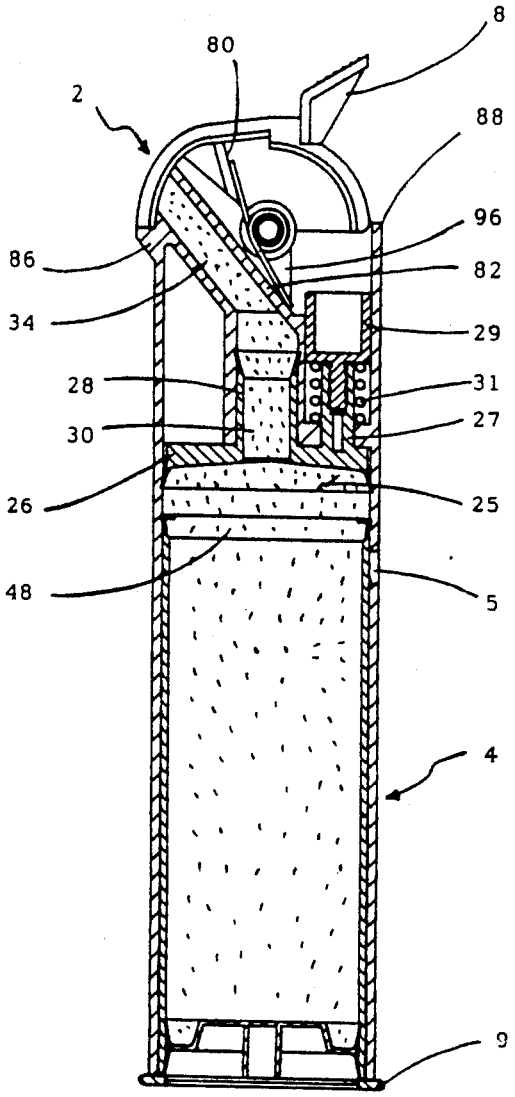
FIG. 1*a* is a front sectional view of the dispenser of the invention which contains a removable cartridge and which shows the cover in a closed position.
Figure 1B:
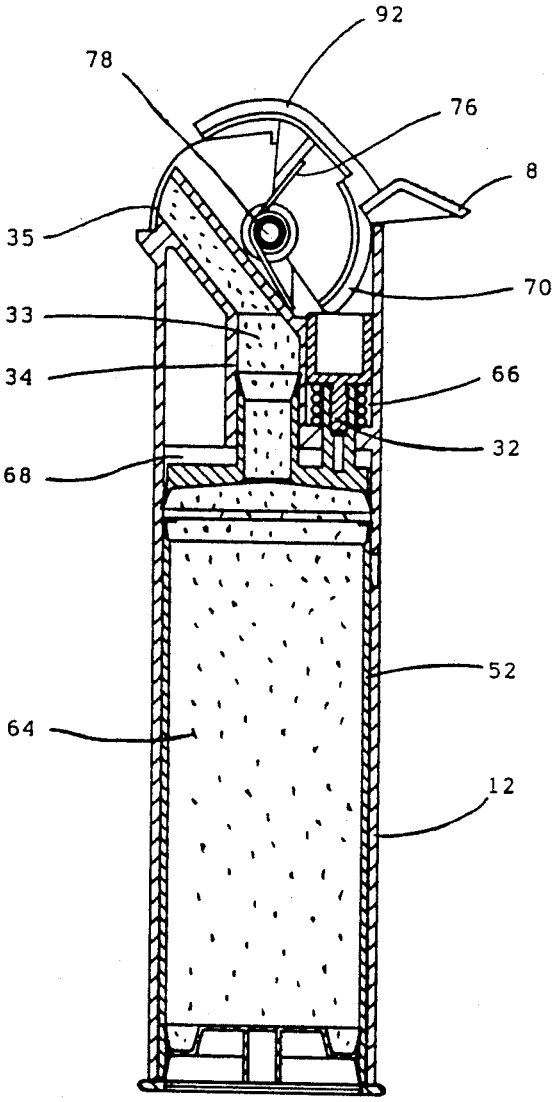
FIG. 1*b* is a front sectional view of the dispenser of FIG. 1*a* with the cover in a fully open position.
Figure 2C:
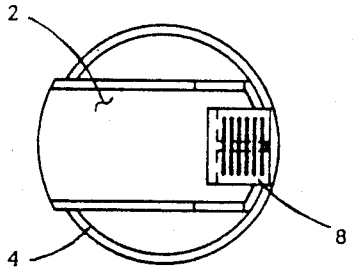
FIG. 2*c* is a top view of the dispenser of FIG. 2*a*.
Figure 2A:
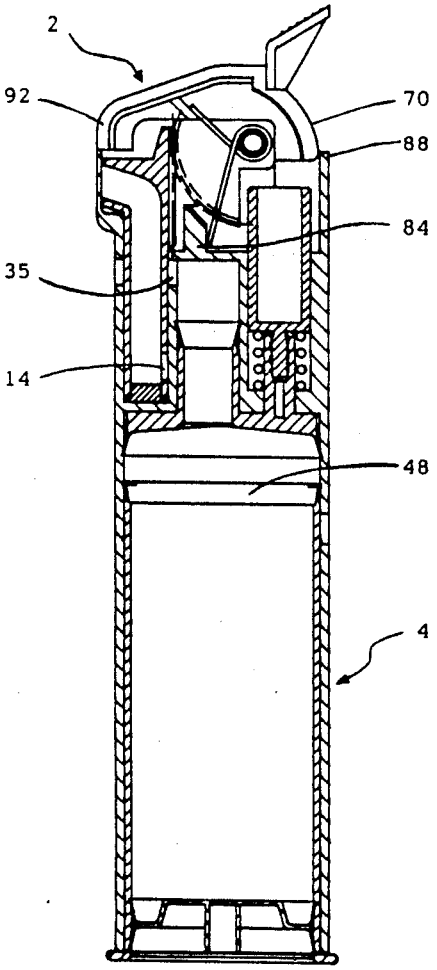
FIG. 2*a* is a front sectional view of a dispenser which shows a movable applicator in a fully extended position, a removable cartridge and the cover in a closed position.
Figure 2B:
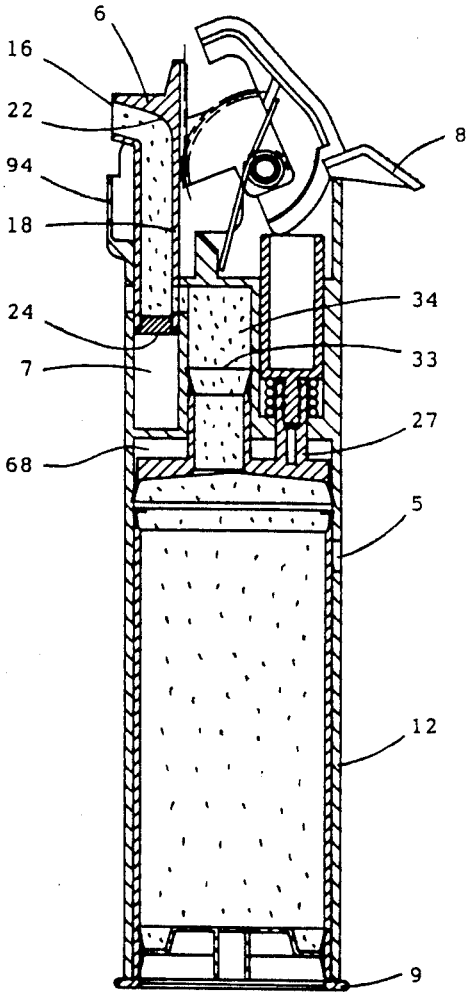
FIG. 2*b* is a front sectional view of the dispenser of FIG. 2*a* with the movable applicator in a retracted position and the cover in a fully open position.

As shown in FIG. 1*a*, 1*b* and 1*c*, the dispenser of this invention includes cover 2, housing 4 and base 9. Included within housing 4 is reservoir 12 which stores paste-like material 64. Cover 2 contains handle 8, sealing cap 92 and plunger 70. Sealing cap 92 is in front of handle 8 and comprises the forward portion of cover 2 whereas plunger 70 is in back of handle 8 and comprises the rear portion of cover 2. Cover 2 is rotatably mounted on one end of housing 4 by axle 78 which extends from both sides of cover 2. The end portions of axle 78 are positioned in slots or support arms 96 which extend from housing 4. Torsion spring 76 is mounted on axle 78. One end of torsion spring 76 is in contact with rib 80 which extends from the side of cover 2 and which functions as a spring stop. The remaining end of torsion spring 76 is in contact with a spring stop 82 positioned on housing 4.

Because of the positioning of torsion spring 76, movement of handle 8 requires application of a force equal and opposite to the torsional force of spring 76. When such a force is initially applied, sealing cap 92 begins sliding over spout 35 which remains covered until the tip of sealing cap 92 reaches the lower edge of spout 35. A continued application of force to handle 8 after the tip of sealing cap 92 moves past the lower edge of spout 35, causes sealing cap 92 to move to a partially open positioned in relation to spout 35 as cover 2 rotates on axle 78. After sealing cap 92 is in an open position, the rotation of cover 2 sequentially causes plunger 70 to activate a pumping mechanism in the housing by transmitting a pumping force thereto. As a result, paste-like material is pumped from reservoir 12 and discharged through spout 35. When cover 2 is in its fully open position as shown in FIG. 1*b*, further rotation of cover 2 is prevented by handle 8 contacting handle stop 88 which is a lip that extends from the side wall of housing 4. The force supplied by torsion spring 76 causes cover 2 to rotate to its closed position when handle 8 is released or when the force applied to it is reduced. Further rotation of cover 2 is prevented when it is in its closed position by sealing cap 92 resting against sealing cap stop 86 which is a lip that extends from the side wall of housing 4. In its closed position, cover 2 provides additional protection to spout 35 and its surroundings against ambient air.

Figure 5:
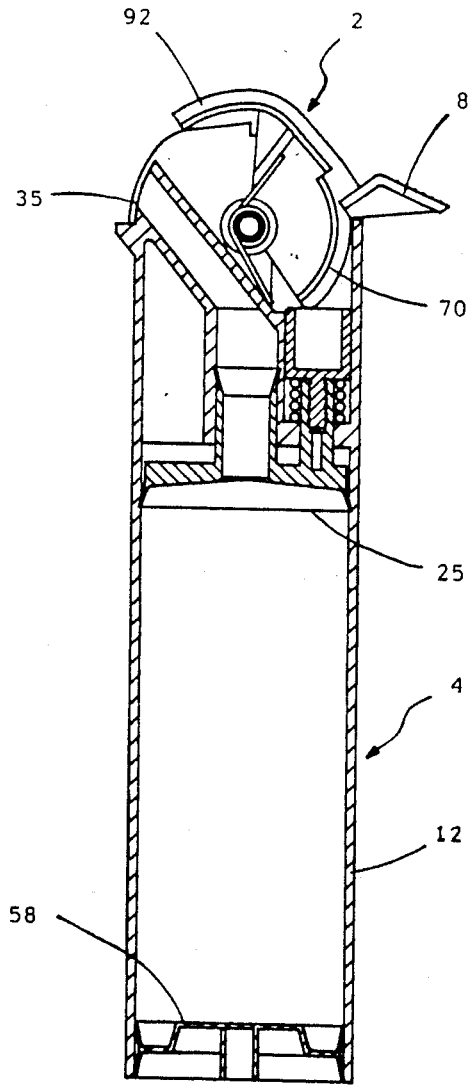
FIG. 5 is a front sectional view of the dispenser of this invention without an applicator and without a cartridge showing the cover in its fully open position.

The paste-like material is either stored directly in reservoir 12 as shown in FIG. 5 or, in accordance with a preferred embodiment, is stored in a removable cartridge. The removable cartridge can be of any shape so long as its shape is compatible with the shape of reservoir 12. As shown in FIGS. 3*a*, 3*b*, 3*c* and 3*d*, removable cartridge 52 is a hollow cylinder with wall 54 and flanged base 9 on one end which also serves as the base for housing 4. A slidable disc 58 is mounted in the flanged end of cartridge 52 to prevent backflow and leakage of paste-like material when a pumping force is applied to the cartridge. The center part 61 of disc 58 has a shape which is conformable to cylinder base 9. Backflow and leakage of material are prevented by annular lip 59 of disc 58. The width of lip 59 is slightly larger than the internal width of the cartridge. Lip 59 is made from a flexible material so as to provide a snug fit when disc 58 is inserted in cartridge 52 and to enhance its sealing capability.

Cartridge 52 also has a flexibly flared end 51 on its other end. A pair of oppositely disposed retention tabs 53 are situated on the inner wall surface of flared end 51. The external width of the cartridge at flared end 51 is slightly greater than the internal width of the reservoir. Flexibly flared end 51 thereby provides a seal to prevent material from leaking from the cartridge when it is under a pumping force. The distance between the oppositely disposed retention tabs 53 is less than the width of disc 58 to prevent movement of the disc beyond the tabs. This arrangement ensures that disc 58 and cartridge 52 are removed from the reservoir together when the cartridge is replaced.

As paste-like material is pumped from cartridge 52, disc 58 slides from the flanged end toward the open end of the cartridge. Backward movement, i.e. movement of the disc toward the flanged base 9 of the cartridge 52, is prevented by a plurality of flexible, radially extending fingers 60 which are positioned on the circumference of disc 58. The maximum width of the disc including the fingers is greater than the internal width of cartridge 52. Thus, when disc 58 is positioned in cartridge 52, the tips of fingers 60 contact the inner wall of cartridge 52. The stubbing force resulting from this contact prevents the backward movement of disc 58. In a preferred embodiment, the inner surface of wall 54 contains a series of grooves 56 having an angular pitch which enhances the uni-directional movement of disc 58. Backward movement of disc 58 is further prevented when the tips of fingers 60 are mated in position with grooves 56 as shown at 62 of FIG. 3*c*.

Referring again to FIG. 1*a* and FIG. 1*b*, cartridge 52 containing paste-like material is inserted in reservoir 12. Disc 58 seals the bottom end of cartridge 52 and ensures that material flows only from the open end 48 of cartridge 52. Cartridge 52 is removable. Thus, when all of the material is used, the empty cartridge is removed and replaced with a full cartridge which is inserted into reservoir 12.

The pump mechanism is positioned in the upper part of housing 4 and contains pump chamber 68 and piston 25. Piston 25 includes piston drive rod 27, and piston drive rod extension 29 which is attached at its base 32 to piston drive rod 27 as shown in FIG. 1*a* and 1*b*. Piston drive rod extension 29 and its spring 31 are positioned in well 66. The top of piston drive rod extension 29 is spaced apart from plunger 70 on cover 2 when no pumping force is applied but is in communication with plunger 70 when a pumping force is applied. Spring 31 rests at the base of well 66 and causes piston drive rod extension 29 to return to its rest position after application of a pumping force, i.e. after handle 8 is released.

Piston 25 is positioned at the output end of reservoir 12. In addition to piston drive rod 27 and piston drive rod extension 29, piston 25 also includes piston head 26 and piston stem 28. Head 26 is also adjacent to open end 48 of cartridge 52. Stem 28 of piston 25 is positioned in channel 34. Orifice 30 comprises an annular opening which extends longitudinally through piston head 26 and piston stem 28. Piston head 26 is preferably concave in shape to facilitate the flow of paste-like material from cartridge 52 through orifice 30 to channel 34. Piston drive rod 27 is part of piston 25 and is on the chamber side of the piston for transmitting a pumping force from handle 8 and plunger 70 to piston head 26.

Housing 4 is made of a moldable material. Thermoplastic resins are particularly suitable since they can be readily shaped using conventional molding techniques. Thus, housing 4 is molded to provide a wall for reservoir 12, a wall for channel 34, well 66, spout 35, support arms 96, handle stop 88, sealing cap stop 86, port 5 as well as other optional recesses as described in other embodiments of the invention.

When cover 2 is in its closed position as shown in FIG. 1*a* and a force is initially applied to handle 8, cover 2 begins to rotate on axle 78. As the tip of sealing cap 92 moves passed spout 35 and the force is continued on handle 8, the space between plunger 70 and the top of piston drive rod extension 29 gradually decreases until plunger 70 contacts piston drive rod extension 29. When a force is further applied to handle 8, spring 31 is compressed and piston drive rod extension 29 causes piston drive rod 27 and piston head 26 to move toward base 9. As piston head 26 moves toward base 9, a partial vacuum is created in pump chamber 68. The pumping force is transmitted to the paste-like material 64 contained in cartridge 52. Because no backflow is possible, material 64, under increased pressure, is caused to flow from cartridge 52 through orifice 30, into channel 34. Spout 35 is in its fully open position as shown in FIG. 1*b* which allows a controlled portion of material to flow from the dispenser.

When the force applied to handle 8 is released, piston drive rod extension 29 and connected piston 25 return to their original positions by the reaction force of spring 31. The partial vacuum previously created in pump chamber 68 also facilitates the return of piston 25 to its original position. At the same time, a pressure lower than atmospheric pressure is created on the cartridge side of piston 25 which causes a volume of material which is equivalent to the volume of pump chamber 68 to advance with piston head 26 and to occupy the space previously created as pump chamber 68. As material moves toward piston 25, disc 58 simultaneously moves in the same direction due to the pressure difference. As previously explained, the movement of disc 58 is unidirectional because of the locking action provided by the positioning of fingers 60 into grooves 56 in wall 54 of cartridge 52. The volume of pump chamber 68 corresponds to the quantity of material discharged through spout 35 during one application. This controlled quantity ensures that excessive material is not used thereby minimizing waste and enhancing efficiency.

Figure 3D:
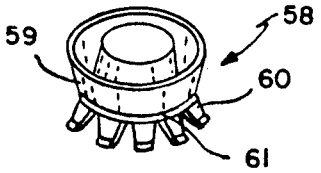
FIG. 3*d* is a perspective view of the disc.
Figure 3C:
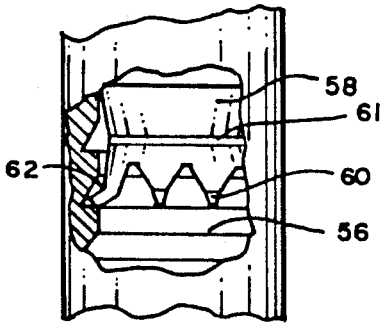
FIG. 3*c* is a partial sectional view of the cartridge of FIG. 3*a* and a disc which is used with the cartridge.
Figure 3B:
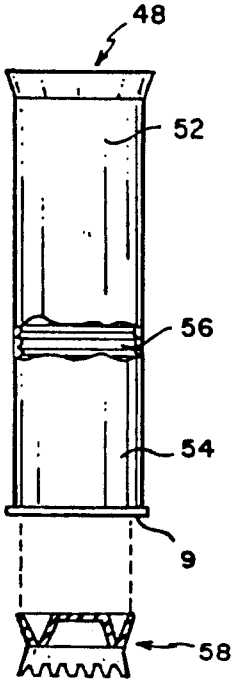
FIG. 3*b* is a cut away pictorial view of the cartridge of FIG. 3*a* and a disc which is used with the cartridge.
Figure 3A:
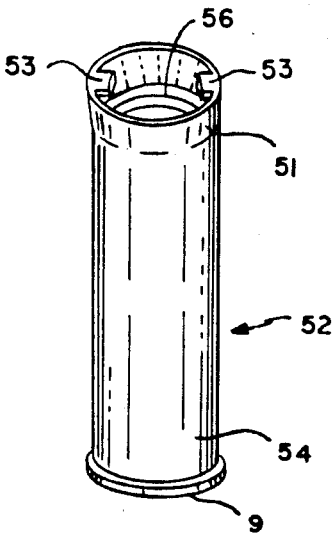
FIG. 3*a* is a perspective view of a cartridge which is inserted in the housing of the dispensers shown in FIGS. 1 and 2.
Figure 4B:
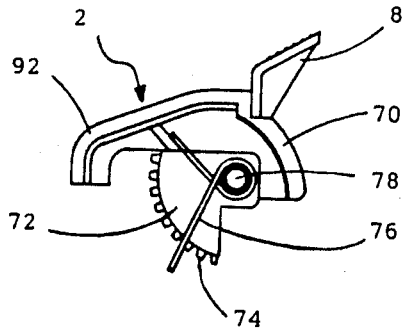
FIG. 4*b* is a front view of the dispenser cover and ratchet wheel.
Figure 4A:
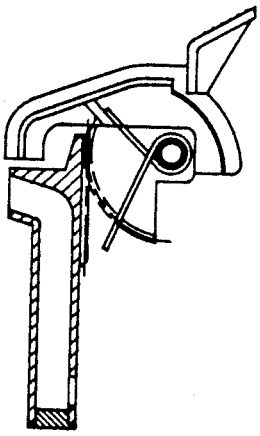
FIG. 4*a* is a front sectional view of the applicator in combination with the dispenser cover ratchet wheel.
Figure 4C:
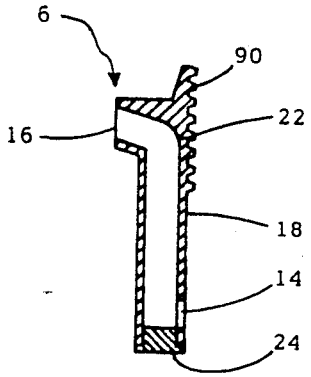
FIG. 4*c* is a front sectional view of the applicator.

In one embodiment of the invention, paste-like material is stored directly in reservoir 12 as shown in FIG. 5 rather than in a removable cartridge. The structure and operation of the dispenser is essentially the same as for the dispenser shown in FIG. 1*a* and 1*b* except that slidable disc 58 of FIG. 3*d* is inserted into the base of reservoir 12. As paste-like material is pumped from reservoir 12, disc 58 advances from the base of the reservoir toward the piston. Backward movement of disc 58 is prevented by radially extending fingers 60 positioned on the circumference of disc 58. The maximum width of the disc including the fingers is greater than the internal width of reservoir 12. When disc 58 is positioned in reservoir 12, the tips of fingers 60 contact the inner wall of reservoir 12. The stubbing force resulting from this contact prevents the backward movement of disc 58.

In another embodiment of the invention, the effluent of paste-like material from channel 34 passes through a movable applicator before being discharged from the dispenser. Movable applicator 6 helps to effect an even distribution of paste-like material onto an application surface. As shown in FIG. *2a* and *2b*, applicator 6 is mounted in recess 7 provided in housing 4. It is comprised of a tube having a closed end 24, an inlet or first opening 14 in the side wall 18 of the tube and an outlet or second opening 16 at the remaining end or in side wall 18 near the remaining end (not shown). Bend 22 facilitates flow of paste like material through th applicator and onto the brush surface. The closed end 24 includes a solid portion which is of sufficient length to block the flow of paste like material into recess 7 when the applicator is in a fully extended dispensing position. It also prevents paste like material from becoming lodged in space which is not in the path of flow of the paste like material.

Rotation of cover 2 to its open position causes applicator 6 to move from a retracted position as shown in FIG. *2a* to a fully extended position as shown in FIG. *2b*. FIG. *4a*, *4b* and *4c* show that movement of applicator 6 is accomplished through the mating of a set of teeth 90 positioned on the outer surface of applicator 6 with a set of teeth 74 on ratchet wheel 72 which is part of cover 2. When cover 2 is in its fully closed position, applicator 6 is fully retracted and second opening 16 is positioned behind sealing lip, 94 which extends from housing 4. First opening 14 is not aligned with the second opening 35 of channel 34 thereby preventing the flow of material from channel 34 to applicator 6. Leakage of material from the applicator's second opening 35 is prevented by sealing lip 94 and sealing cap 92. When a force is initially applied to handle 8, cover 2 and ratchet wheel 72 begin to rotate on axle 78. Ratchet wheel 72 causes applicator 6 to move toward its extended position through teeth 74 and 90 which are associated with ratchet wheel 72 and applicator 6 respectively. Because of the space between plunger 70 and piston drive rod extension 29, a pumping force is not immediately applied and no material is pumped when cover 2 begins its rotation. As force continues to be applied to handle 8 and cover 2 continues its rotation, plunger 70 contacts piston drive rod extension 29 which causes material to be pumped from cartridge 52. When plunger 70 contacts piston drive rod extension 29 and the pumping action begins, applicator 6 continues to become extended and its second opening 16 emerges from behind sealing lip 94 and is no longer blocked by it.

When handle 8 contacts stop 88, cover 2 is in its fully opened position and applicator 6 is its fully extended position. The applicator's first opening 14 is aligned with the second opening 35 of channel 34 which permits pumped material to flow from channel 34 to applicator 6. The flow of material begins prior to the applicator reaching its fully extended position at a point when the overlap of openings 14 and 35 begins to occur and continues until the alignment and pumping action are fully completed. Thus, material emerges from applicator opening 16 while it is in motion. This helps to enable an even distribution of a length of paste-like material onto the surface which it is applied. This is particularly advantageous where the application surface is stationary or the dispenser is not movable because of its attachment to a support surface. When handle 8 is released or the force applied to it is reduced to less than the torsional force provided by spring 76, cover 8 returns to its closed position and applicator 6 returns to its fully retracted position. In this position, outlet 16 automatically becomes sealed closed by lip 94 which prevents caking or drying out of material when the dispenser is not in use.

Each of the parts which are in the path of flow of the paste like material are sealed so as to prevent unwanted leakage. The design of disc 58 prevents leakage when dentifrice material is pumped from cartridge 52. Piston 25, applicator 6 and the housing 4 are interpositioned so as to provide enhanced flow and t provide seals against leakage of dentifrice material. The space between plunger 70 and piston drive rod extension 29 ensures that no material is caused to be pumped from the dispenser because of a slight or accidental movement of handle 8.

Port 5 is provided in housing for viewing the material 64 in cartridge 52. This serves to alert the user as to when the cartridge is nearing an empty state and in need of replacement before it is completely empty. Port 5 also allows trapped air to be vented from the housing when the cartridge is inserted into the housing.

The advantages of the dispenser of the invention are readily apparent from the foregoing description. A reusable dispenser is provided which is replenished by removing an empty cartridge and replacing it with one that is filled with material. A movable applicator aids in the distribution of material to a surface. The configuration of parts protects against unwanted leakage and ensures that the spout is closed thereby preventing material from caking and clogging the spout when the dispenser is not in use. Removal and replacement of the cover and dispensing of material are facilitated since these functions are simultaneously and automatically accomplished by applying or releasing the force on handle 8. The operation is particularly advantageous to physically handicapped individuals since it can be accomplished with one hand. It is also advantageous for young children who may be careless replacing the cover. Because the cover is attached to the housing, it cannot become separated or lost.

The invention has been described in detail with reference to a preferred embodiment thereof. However, it will be understood that variations and modifications can be effected within the spirit and scope of the invention. For example, a cartridge can be configured in a manner such that a disc can be used in conjunction with cartridge walls which do not contain grooves. Also, flexible, radially extending fingers 60 can be replaced by a flexible annular flange which is positioned along the circumference of disc 58.

For purposes of this application, the width or maximum dimension of the cartridge is the length of the longest chord which passes through the center of a cross-sectional plane of the cartridge. The width or maximum dimension of the disc is defined as the length of the longest finger to finger chord which passes through the center of the disc.

Other principles employed for the design and function of the dispenser of this invention are readily transferable to other useful applications.

I claim:

1. A dispenser for paste-like material comprising:

a. a housing;

b. a reservoir situated within the housing for storing paste-like material;

c. a stationary channel immovably fixed within the housing, said stationary channel having a first opening and a second opening;

d. a well comprising a recess fixed within the housing and outside of and laterally offset from the stationary channel;

e. pumping means comprising a piston having i. a piston head slidably mounted in the housing between the stationary channel and the reservoir;

ii. a piston stem attached to the piston head and slidably mounted within the stationary channel;

iii. an orifice which extends longitudinally through the piston head and piston stem; and iv. drive rod means having a lower end attached to the piston head and an upper end slidably mounted in the well;

f. a cover rotatably attached to an end of the housing;

g. a cap attached to the cover for sealing and unsealing the second channel opening as the cover is rotated; and h. a plunger attached to the cover for supplying a pumping force which sequentially activates the pumping means after rotational movement of the cover causes the cap to unseal the second channel opening, said plunger being spaced apart from the upper end of the drive rod means when the second channel opening is being sealed and said plunger being in contact with the upper end of the drive rod means when the second channel opening is being unsealed.

2. The dispenser described in claim 1 wherein a spring enables the piston to return to the same position after each application of pumping force.

3. The dispenser described in claim 1 wherein the reservoir includes a removable cartridge for storing paste-like material.

4. The dispenser described in claim 3 wherein the removable cartridge comprises a hollow cylinder having one flared end and one unflared end, a disc having a shape which is conformable to the shape of the unflared base end and being slidably mounted within the hollow cylinder, and retention tabs attached to the hollow cylinder at its flared end to prevent the movement of the disc beyond the tabs.

5. The dispenser described in claim 3 wherein the removable cartridge comprises a hollow cylinder having a grooved inner wall surface and a disc having a shape which is conformable to the shape of the cylinder base and being slidably mounted within the cylinder, said disc having a plurality of flexible, radially extending fingers positioned on the circumference of the disc, the width of the disc including the flexible, radially extending fingers being greater than the internal width of the cylinder whereby the ends of the flexible radially extending fingers are matable in the grooves of the inner wall surface.

6. The dispenser described in claim 3 wherein the housing includes a port for viewing the paste-like material in the removable cartridge and for venting air from the housing when the removable cartridge is inserted in the housing.

* * * * *